US008528285B2

(12) United States Patent
Kornfalt

(10) Patent No.: US 8,528,285 B2
(45) Date of Patent: Sep. 10, 2013

(54) JOINT COVER ASSEMBLY AND KIT COMPRISING THIS JOINT COVER ASSEMBLY AS WELL AS INSTALLATION METHOD THEREOF

(75) Inventor: Sven Kornfalt, Malmo (SE)

(73) Assignee: Pergo (Europe) AB, Trelleborg (SE)

( * ) Notice: Subject to any disclaimer, the term of this patent is extended or adjusted under 35 U.S.C. 154(b) by 220 days.

(21) Appl. No.: 12/731,645

(22) Filed: Mar. 25, 2010

(65) Prior Publication Data

US 2010/0242393 A1 Sep. 30, 2010

Related U.S. Application Data

(60) Provisional application No. 61/163,902, filed on Mar. 27, 2009.

(51) Int. Cl.
*E04F 15/14* (2006.01)

(52) U.S. Cl.
USPC ..... 52/395; 52/464; 52/716.4

(58) Field of Classification Search
USPC ..... 52/464, 466, 468, 716.4, 592.1, 395
See application file for complete search history.

(56) References Cited

U.S. PATENT DOCUMENTS

| | | | | |
|---|---|---|---|---|
| 1,357,713 A | | 11/1920 | Lane | |
| 1,576,527 A | * | 3/1926 | McBride | 296/29 |
| 1,736,539 A | | 11/1929 | Lachman | |
| 1,942,137 A | | 1/1934 | Connell et al. | |
| 1,966,020 A | | 7/1934 | Rowley | |

(Continued)

FOREIGN PATENT DOCUMENTS

| | | |
|---|---|---|
| BE | 1010487 | 10/1998 |
| CA | 991373 | 6/1976 |

(Continued)

OTHER PUBLICATIONS

Encyclopedia of Chemical Technology, 3rd Edition, vol. 23, "Thyroid and Antithyroid Preparations to Vinyl Polymers", 1983, John Wiley & Sons; USA.

(Continued)

*Primary Examiner* — William Gilbert
*Assistant Examiner* — James Ference
(74) *Attorney, Agent, or Firm* — Jenkins, Wilson, Taylor & Hunt, P.A.

(57) ABSTRACT

The invention relates to a joint cover assembly for covering a gap between two floor elements covering a subsurface, the assembly comprising a first molding element comprising an upper section having an exposed surface, the exposed surface comprising a décor, and a foot depending therefrom, wherein the foot has a gripping groove extending towards the exposed surface and being defined by two side walls; and a second molding element comprising an upper surface and a lower surface, to be joined to the first molding element, as well as an exposed surface comprising a décor, wherein the lower surface has a groove extending towards the upper surface and being defined by two side walls; characterized in that the joint cover assembly furthermore comprises a track having two upstanding sections, wherein the distance between the upstanding sections corresponds substantially to the width of the foot and also to the distance between a gripping groove's side wall and a proximal side wall of the second molding element's groove. Furthermore, the invention relates to a kit comprising such joint cover assembly. Finally, the invention relates to a method of covering a sub floor adjacent a floor element by using this joint cover assembly or this kit.

20 Claims, 2 Drawing Sheets

(56) References Cited

U.S. PATENT DOCUMENTS 2,100,238 A 11/1937 Burgess
2,194,086 A 3/1940 Horn
2,363,429 A * 11/1944 Lowry ..... 52/396.05
2,796,624 A 6/1957 Speer
2,926,401 A 3/1960 Place
2,996,751 A 8/1961 Roby et al.
3,028,938 A 4/1962 Wallace
3,162,906 A 12/1964 Dudley
3,199,258 A 8/1965 Jentoft
3,286,425 A 11/1966 Brown
3,296,056 A 1/1967 Bechtold
3,331,171 A 7/1967 Hallock
3,339,329 A * 9/1967 Berg ..... 52/395
3,362,127 A 1/1968 McGowan
3,363,381 A * 1/1968 Forrest ..... 52/464
3,363,382 A 1/1968 Forrest
3,411,977 A * 11/1968 Slater, Jr. ..... 428/33
3,435,574 A 4/1969 Hallock
3,488,828 A 1/1970 Gallagher
3,508,369 A 4/1970 Tennison
3,543,326 A * 12/1970 Rohrberg et al. ..... 16/16
3,570,205 A 3/1971 Payne
3,665,666 A * 5/1972 Delcroix ..... 52/461
3,667,177 A * 6/1972 Biela ..... 52/278
3,670,470 A 6/1972 Thom
3,671,369 A 6/1972 Kvalheim
3,696,461 A * 10/1972 Kelly ..... 16/16
3,696,575 A 10/1972 Armstrong
3,745,726 A 7/1973 Thom
3,758,650 A 9/1973 Hurst
3,760,544 A * 9/1973 Hawes et al. ..... 52/468
3,810,707 A 5/1974 Tungseth
3,953,661 A 4/1976 Gulley
D240,221 S 6/1976 Hinze
4,059,933 A 11/1977 Funk
4,067,155 A * 1/1978 Ruff et al. ..... 52/105
4,198,455 A 4/1980 Spiro et al.
4,244,102 A 1/1981 Bolles
4,292,774 A * 10/1981 Mairle ..... 52/208
4,445,306 A 5/1984 Schauffele
4,455,803 A * 6/1984 Kornberger ..... 52/395
4,461,131 A 7/1984 Pressell
4,474,197 A 10/1984 Kinoshita
4,504,347 A 3/1985 Munk et al.
4,520,062 A 5/1985 Ungar
4,594,347 A 6/1986 Ishikawa
4,643,237 A 2/1987 Rosa
4,653,138 A 3/1987 Carder
4,736,563 A * 4/1988 Bilhorn ..... 52/460
4,747,197 A 5/1988 Charron
4,757,657 A 7/1988 Mitchell
4,806,435 A 2/1989 Athey
4,833,956 A 5/1989 Roberts
4,893,449 A * 1/1990 Kemper ..... 52/464
4,940,503 A 7/1990 Lindgren
5,034,272 A 7/1991 Lindgren
5,074,089 A * 12/1991 Kemmer et al. ..... 52/395
5,155,952 A * 10/1992 Herwegh et al. ..... 52/100
5,288,540 A 2/1994 Albrinck et al.
5,365,713 A * 11/1994 Nicholas et al. ..... 52/573.1
5,451,451 A 9/1995 Minnick
5,469,666 A 11/1995 Lewis, Jr.
D373,203 S 8/1996 Kornfalt
5,581,967 A 12/1996 Glatz
5,638,653 A * 6/1997 Rossi ..... 52/511
5,653,072 A 8/1997 Seelandt-Stasek et al.
5,657,598 A * 8/1997 Wilbs et al. ..... 52/287.1
5,688,569 A 11/1997 Gilmore
5,695,875 A 12/1997 Larsson
5,706,623 A * 1/1998 Brown ..... 52/718.04
5,769,562 A 6/1998 Jones
5,888,017 A 3/1999 Corrie
5,937,612 A 8/1999 Winer et al.
5,939,670 A 8/1999 Shteynberg et al.
6,073,408 A 6/2000 Winer et al.
6,093,473 A 7/2000 Min
6,115,975 A 9/2000 Abdollahi
6,134,854 A 10/2000 Stanchfield
6,141,920 A 11/2000 Kemper
6,148,584 A 11/2000 Wilson
6,158,915 A 12/2000 Kise
6,219,982 B1 4/2001 Eyring
6,230,385 B1 * 5/2001 Nelson ..... 29/450
6,230,410 B1 5/2001 Taylor et al.
6,253,514 B1 7/2001 Jobe
6,298,561 B1 10/2001 Decker
6,345,480 B1 * 2/2002 Kemper et al. ..... 52/395
6,360,500 B1 3/2002 Wilcox
6,421,970 B1 7/2002 Martensson et al.
6,517,935 B1 2/2003 Kornalt et al.
6,536,178 B1 3/2003 Palsson et al.
6,550,192 B1 * 4/2003 Nelson et al. ..... 52/177
6,550,205 B2 * 4/2003 Neuhofer, Jr. ..... 52/464
6,560,944 B1 5/2003 Wilson
6,588,165 B1 * 7/2003 Wright ..... 52/506.05
6,591,568 B1 7/2003 Palsson
6,606,827 B1 8/2003 Hoffmann
6,647,680 B2 11/2003 Daly et al.
6,745,534 B2 * 6/2004 Kornfalt ..... 52/468
6,805,951 B2 10/2004 Kornfalt
6,823,638 B2 11/2004 Stanchfield
6,860,047 B1 3/2005 Rodriguez
6,860,074 B2 * 3/2005 Stanchfield ..... 52/464
D504,181 S 4/2005 Stanchfield
D504,730 S 5/2005 Kornfalt et al.
D504,731 S 5/2005 Stanchfield
D505,211 S 5/2005 Stanchfield
6,898,911 B2 5/2005 Kornfalt et al.
6,964,075 B1 11/2005 Iannacone, Jr.
6,988,345 B1 1/2006 Pelfrey et al.
6,991,830 B1 1/2006 Hansson
7,003,364 B1 2/2006 Hansson
7,029,741 B2 4/2006 Sjoberg
7,037,024 B2 5/2006 Steinwender
7,065,931 B2 6/2006 Kornfalt et al.
7,091,579 B2 8/2006 Nemoto
7,150,134 B2 * 12/2006 Kornfalt et al. ..... 52/416
7,188,456 B2 3/2007 Knauseder
7,207,143 B2 * 4/2007 Stanchfield ..... 52/459
D542,939 S * 5/2007 Neuhofer, Jr. ..... D25/136
D542,941 S * 5/2007 Neuhofer, Jr. ..... D25/136
7,287,357 B2 * 10/2007 Gomez Insa ..... 52/464
7,389,613 B2 6/2008 Sondermann
7,441,384 B2 10/2008 Miller
7,476,351 B2 1/2009 Nilsson
7,559,177 B2 7/2009 Stanchfield
7,640,705 B2 1/2010 Kornfalt et al.
7,640,706 B2 1/2010 Stanchfield
7,644,553 B2 1/2010 Knauseder
7,735,283 B2 * 6/2010 Stanchfield ..... 52/464
7,784,237 B2 8/2010 Stanchfield
7,793,483 B2 * 9/2010 Stanchfield et al. ..... 52/716.1
7,814,720 B2 * 10/2010 Neuhofer ..... 52/471
7,820,287 B2 10/2010 Kornfalt
7,862,670 B2 1/2011 Hansson
7,908,819 B2 3/2011 Neuhofer, Jr.
8,122,665 B2 * 2/2012 Stanchfield et al. ..... 52/468
8,205,410 B2 6/2012 Stanchfield
8,327,595 B2 12/2012 Stanchfield
2001/0037617 A1 11/2001 Chi
2002/0025446 A1 2/2002 Chen et al.
2002/0108323 A1 8/2002 Gruber
2002/0127374 A1 9/2002 Spratling
2003/0084634 A1 * 5/2003 Stanchfield ..... 52/464
2003/0118812 A1 * 6/2003 Kornfalt et al. ..... 428/331
2003/0141004 A1 7/2003 Palmblad et al.
2003/0154678 A1 * 8/2003 Stanchfield ..... 52/468
2003/0159389 A1 * 8/2003 Kornfalt et al. ..... 52/396.04
2003/0207083 A1 11/2003 Hansson et al.
2004/0206038 A1 * 10/2004 Stanchfield ..... 52/582.1
2005/0003149 A1 * 1/2005 Kornfalt et al. ..... 428/120
2005/0150182 A1 * 7/2005 Stanchfield ..... 52/459
2005/0166526 A1 * 8/2005 Stanchfield ..... 52/716.1
2006/0174556 A1 * 8/2006 Kornfalt et al. ..... 52/181

| | | | | |
|---|---|---|---|---|
| 2006/0201093 | A1* | 9/2006 | Stanchfield | 52/459 |
| 2006/0260241 | A1* | 11/2006 | Stanchfield | 52/459 |
| 2007/0107344 | A1* | 5/2007 | Kornfalt et al. | 52/395 |
| 2007/0125021 | A1 | 6/2007 | Theirs et al. | |
| 2007/0245662 | A1* | 10/2007 | Stanchfield | 52/459 |
| 2007/0266638 | A1* | 11/2007 | Neuhofer | 49/468 |
| 2007/0283654 | A1* | 12/2007 | Stanchfield et al. | 52/465 |
| 2008/0034696 | A1* | 2/2008 | Neuhofer | 52/466 |
| 2008/0034700 | A1* | 2/2008 | Stanchfield et al. | 52/582.1 |
| 2008/0066419 | A1* | 3/2008 | Stanchfield et al. | 52/716.1 |
| 2008/0168729 | A1 | 7/2008 | Brunedal | |
| 2008/0263983 | A1* | 10/2008 | Stanchfield et al. | 52/459 |
| 2012/0272602 | A1 | 11/2012 | Stanchfield et al. | |
| 2012/0324817 | A1 | 12/2012 | Stanchfield | |

FOREIGN PATENT DOCUMENTS

| | | |
|---|---|---|
| DE | 2159042 | 11/1971 |
| DE | 2238660 | 2/1974 |
| DE | 2502992 | 1/1975 |
| DE | 2638518 | 3/1977 |
| DE | 3041781 | 6/1982 |
| DE | 3343601 | 2/1983 |
| DE | 3544845 | 6/1987 |
| DE | 3640822 | 6/1988 |
| DE | 3932980 | 3/1989 |
| DE | 29600057 | 4/1996 |
| DE | 29618803 | 2/1997 |
| DE | 29703962 | 4/1997 |
| DE | 19951516 | 10/1999 |
| DE | 19821938 | 11/1999 |
| DE | 29929645 | 3/2000 |
| DE | 20100413 | 4/2002 |
| DE | 10131248 | 1/2003 |
| EP | 1111155 | 12/1999 |
| EP | 0788576 | 9/2000 |
| EP | 1310613 | 5/2003 |
| FR | 2 268 922 | 11/1975 |
| GB | 424057 | 2/1935 |
| GB | 812671 | 4/1959 |
| GB | 1348272 | 4/1971 |
| GB | 1430423 | 5/1974 |
| GB | 2088280 | 6/1982 |
| GB | 2096665 | 10/1982 |
| GB | 2117813 | 10/1983 |
| GB | 2141457 | 12/1984 |
| GB | 2256023 | 11/1992 |
| JP | 3169967 | 7/1991 |
| SE | 467150 | 0/6199 |
| SE | 501014 | 10/1994 |
| SE | 502994 | 3/1996 |
| SE | 503861 | 9/1996 |
| SE | 9904533 | 6/2001 |
| SE | 517353 | 5/2002 |
| WO | WO 93/13280 | 7/1993 |
| WO | WO 94/01628 | 1/1994 |
| WO | WO 94/26999 | 11/1994 |
| WO | WO 9612857 | 5/1996 |
| WO | WO 96/27719 | 9/1996 |
| WO | WO 9731775 | 9/1997 |
| WO | WO 9731776 | 9/1997 |
| WO | WO 9822678 | 5/1998 |
| WO | WO 99/01628 | 1/1999 |
| WO | WO 99/66151 | 12/1999 |
| WO | WO 0014351 | 3/2000 |
| WO | WO 01/20101 | 3/2001 |
| WO | WO 01/31141 | 5/2001 |
| WO | WO 0142589 | 6/2001 |
| WO | WO 0240809 | 5/2002 |
| WO | WO 03/016657 | 2/2003 |
| WO | WO 0304092 | 5/2003 |
| WO | WO 0309366 | 11/2003 |
| WO | WO 2005/083195 | 2/2004 |
| WO | WO 2005/049938 | 6/2005 |
| WO | WO 2005/-59269 | 6/2005 |
| WO | WO 2005/065381 | 7/2005 |
| WO | WO 2005/083196 | 9/2005 |
| WO | WO 2005/116364 | 12/2005 |
| WO | WO 2005/122667 | 12/2005 |
| WO | WO 2006/093866 | 9/2006 |

OTHER PUBLICATIONS

Sweets Catalog File, Products for General Building and Renovation; McGraw Hill Information Systems Co.; Feb. 1986, pp. 18-19.
Time Life Catalog;pp. 1-35; 1994
"Wood Flooring," Floors, Stairs & Carpets, Time Life Books , Inc., Jan. 1994, p. 14.
Fix it Yourself, Floors, Stairs, & Carpets. Time Life Books, St. Remy Press, ISBN0-376-01909-3, pp. 14-35, Jan. 1994.
Vila, Bob, Bob Vila's Workshop: The Ultimate Illustrated Handbook for the Home Workshop, William Morrow and Company, Inc., published Oct. 5, 1994, pp. 107-112.
Magazin Parkett; Feb. 1995.
International Search Report of PCT/SE95/01206 dated Nov. 21, 1995.
Marcarena Flooring; Formica Corporation 1998.
Final Office Action for U.S. Appl. No. 08/817,391 dated Jul. 8, 1998.
Examiner Interview Summary for U.S. Appl. No. 08/817,391 dated Dec. 9, 1998.
Formica Flooring Catalog; Formica Corportion 1999.
Pergo Original Catalog, Jan. 1999.
Notice of Allowance for U.S. Appl. No. 08/817,391 dated Nov. 6, 2002.
Search Report for PCT/IB02/04737 dated Dec. 3, 2003.
Non-final Office Action for U.S. Appl. No. 10/347,489 dated Feb. 18, 2004.
Non-final Office Action or U.S. Appl. No. 10/748,852 dated Feb. 18, 2004.
Non-Final Office Action for U.S. Appl. No. 10/319,820 dated Mar. 25, 2004.
Notice of Allowance for U.S. Appl. No. 10/360,802 dated Jul. 16, 2004.
Examiner Interview Summary for U.S. Appl. No. 10/360,802 dated Jul. 16, 2004.
Final Office Action for U.S. Appl. No. 10/319,820 dated Jul. 26, 2004.
Notice of Allowance for U.S. Appl. No. 10/347,489 dated Aug. 23, 2004.
Notice of Allowance for U.S. Appl. No. 10/748,852 dated Aug. 23, 2004.
Notice of Allowance for U.S. Appl. No. 10/319,820 dated Nov. 4, 2004.
Notice of Allowance for U.S. Appl. No. 29/208,500 dated Dec. 2, 2004.
Supplemental Notice of Allowance for U.S. Appl. No. 10/319,820 dated Mar. 9, 2005.
Non-Final Office Action for U.S. Appl. No. 10/902,062 dated Apr. 5, 2005.
Final Office Action for U.S. Appl. No. 10/902,062 dated Nov. 28, 2005.
Notice of Allowance for U.S. Appl. No. 10/902,062 dated Mar. 15, 2006.
Non-Final Office Action for U.S. Appl. No. 11/140,075 dated Apr. 28, 2006.
Non-final Office Action for U.S. Appl. No. 11/343,199 Jul. 10, 2006.
Search Report Dated Aug. 9, 2006.
International Search Report dated Aug. 22, 2006.
Notice of Allowance for U.S. Appl. No. 11/140,075 dated Sep. 14, 2006.
Notice of Allowance for U.S. Appl. No. 11/343,199 dated Dec. 14, 2006.
Non-Final Office Action for U.S. Appl. No. 11/640,351 dated Jun. 26, 2007.
Non-Final Office Action for U.S. Appl. No. 11/785,176 dated Sep. 17, 2007.
Final Office Action for U.S. Appl. No. 11/640,351 dated Dec. 13, 2007.
Non-Final Office Action for U.S. Appl. No. 11/785,176 dated Mar. 26, 2008.
Non-Final Office Action for U.S. Appl. No. 11/907,965 dated Jun. 23, 2008.
Non-final Office Action for U.S. Appl. No. 11/785,174 dated Jul. 10, 2008.

Examiner Interview Summary for U.S. Appl. No. 11/640,351 dated Jul. 23, 2008.
Non-Final Office Action for U.S. Appl. No. 11/640,351 dated Aug. 12, 2008.
Non-final Office Action for U.S. Appl. No. 11/066,099 dated Sep. 15, 2008.
Non-Final Office Action for U.S. Appl. No. 10/895,329 dated Oct 8, 2008.
Final Office Action for U.S. Appl. No. 11/785,176 dated Nov. 10, 2008.
International Search Report, Nov. 10, 2008.
Final Office Action for U.S. Appl. No. 11/907,965 dated Dec. 11, 2008.
Final Office Action for U.S. Appl. No. 11/066,099 dated Apr. 14, 2009.
Final Office Action for U.S. Appl. No. 11/640,351 dated Apr. 22, 2009.
Non-Final Office Action for U.S. Appl. No. 11/400,519 dated Apr. 24, 2009.
Non-Final Office Action for U.S. Appl. No. 11/785,176 dated May 28, 2009.
Advisory Action for U.S. Appl. No. 11/066,099 dated Aug. 14, 2009.
Notice of Allowance for U.S. Appl. No. 11/400,519 dated Aug. 24, 2009.
Final Office Action for U.S. Appl. No. 10/895,329 dated Sep. 16, 2009.
Final Office Action for U.S. Appl. No. 11/785,174 dated Oct. 28, 2009.
Non-Final Office Action for U.S. Appl. No. 11/785,176 dated Nov. 24, 2009.
Notice of Allowance for U.S. Appl. No. 11/785,174 dated Feb. 16, 2010.
Notice of Allowance for U.S. Appl. No. 11/066,099 dated Febl. 18, 2010.
Notice of Allowance for U.S. Appl. No. 10/895,329 dated Jun. 25, 2010.
Non-Final Office Action for U.S. Appl. No. 11/785,176 dated Jun. 29, 2010.
Non-Final Office Action for U.S. Appl. No. 11/984,091 dated Jul. 7, 2010.
Office Action/Restrition Requirement for U.S. Appl. No. 12/787,199 dated Oct. 25, 2010.
Supplemental European Search Report dated Nov. 19, 2010.
Final Office Action for U.S. Appl. No. 11/984,091 dated Nov. 23, 2010.
Non-Final Office Action for U.S. Appl. No. 11/785,176 dated Jan. 6, 2012.
Final Office Action for U.S. Appl. No. 11/785,176 dated Jan. 20, 2011.
Non-final Office Action or U.S. Appl. No. 12/787,199 dated Jan. 21, 2011.
Notice of Allowance for U.S. Appl. No. 12/787,199 dated Feb. 27, 2012.
Examination Report for European Application Serial No. EP 04815942 dated Apr. 23, 2012.
Non-Final Office Action for U.S. Appl. No. 11/907,965 dated Jun. 27, 2012.
Examiner Interview Summary for U.S. Appl. No. 11/785,176 dated Jul. 2, 2012.
Notice of Allowance for U.S. Appl. No. 11/785,176 dated Aug. 6, 2012.
Final Office Action for U.S. Appl. No. 11/907,965 dated Nov. 8, 2012.
Non-Final Office Action for U.S. Appl. No. 13/532,590 dated Nov. 28, 2012.
Notice of Allowance for U.S. Appl. No. 11/907,965 dated Jan. 23, 2013.
Non-Final Office Action for U.S. Appl. No. 13/52,590 dated Jan. 25, 2013.
Notice of Allowance for U.S. Appl. No. 11/640,351 dated Feb. 4, 2013.
Bob Vila's Workshop—The Ultimate Illustrated Handbook for the Home Workshop, Bob Vila.
B.S. Bauprogram Handelsgesellschaft mbH Catalog.
Ceiling Program.
Decades Laminate Flooring.
Faus Group Catalog.
FN Neuhofer Holz, "Profiles in Various Kinds and Innovative Accessories," Certified according to DIN EN IS 9002 (Neuhofer Holz Catalog).
German Search Report.
Haro Wand und Decke (Haro Catalog).
Meister Panels; Meister-Listen Schulte GmbH.
Original Pergo the Free and Easy Floor (Pergo Catalog).
Pergo Original Catalog.
Reexamination U.S. Appl. No. 90/007,365.
Reexamination U.S. Appl. No. 90/007,526.
Reexamination U.S. Appl. No. 90/007,366.
Search Report for PCT/US04/43953.
Time Life Books; "Floors, Stairs, Carpets", p. 14.
"Wohnkultur-von der Natur gestaltet" (Haro Catalog).
Restriction Requirement for U.S. Appl. No. 13/406,125 dated Feb. 8, 2013.
Notice of Allowance for U.S. Appl. No. 11/907,965 dated Mar. 11, 2013.

* cited by examiner

JOINT COVER ASSEMBLY AND KIT COMPRISING THIS JOINT COVER ASSEMBLY AS WELL AS INSTALLATION METHOD THEREOF

CROSS-REFERENCE TO RELATED APPLICATION

This application is a Non-Provisional of U.S. Provisional Application Ser. No. 61/163,902, filed Mar. 27, 2009, the entire disclosure of which are herein incorporated by reference.

1. Field of the Invention

The invention is a joint cover assembly that includes a molding, similar to a transition molding between two separate parts, such as a T-Molding, for covering a gap that may be formed between adjacent panels in a generally planar surface, such as between two adjacent flooring or wall or ceiling materials; or between a floor and a hard surface or carpet, or even a riser and a runner in a step (or a series of steps).

2. Background of the Invention

Hard surface floors, such as wood (solid or engineered) or laminate flooring have become increasingly popular. As such, many different types of this flooring are assembled by providing a plurality of similar panels. The differing types of panels that have developed, of course, may have differing depths and thicknesses. The same is true when a laminate floor (often referred to as "floating floor") abuts another hard surface, such as a resilient surface (such as vinyl), tile or another laminate surface, a ceramic surface, or other surface, e.g., natural wood flooring. Thus, when laminate panels having different thicknesses or different floor covering materials are placed adjacent to a laminate floor, transition moldings are often used to create a transition between the same.

Additionally, one may desire to install floor panels adjacent to an area with different types of material. For example, one may desire to have one type of flooring in a kitchen (e.g., solid wood, resilient flooring, laminate flooring or ceramic tile), and a different appearance in an adjacent living room (e.g., linoleum or carpeting), and an entirely different look in an adjacent bath. Therefore, it has become necessary to develop a type of molding or floorstrip that could be used as a transition from one type of flooring to another, A problem is encountered, however, when flooring materials that are dissimilar in shape or texture ere used. For example, when a hard floor is placed adjacent a carpet, problems are encountered with conventional edge moldings placed therebetween. Such problems include difficulty in covering the gap that may be formed between the floorings having different height, thickness or texture.

Moreover, for purposes of reducing cost, it is important to be able to have a molding that is versatile, having the ability to cover gaps between relatively coplanar surfaces, as well as surfaces of differing thicknesses.

It would also be of benefit to reduce the number of molding profiles that need to be kept in inventory by a seller or installer of laminate flooring. Thus, the invention also provides a method by which the number of moldings can be reduced while still providing all the functions necessary of different styles transition moldings.

SUMMARY OF THE INVENTION

The invention is a joint cover assembly for covering a gap between edges of adjacent floor elements, such as floor panels of laminate or wood, although it may also be used as a transition between a laminate panel and another type of flooring, e.g., carpet, linoleum, ceramic, wood, etc. The assembly typically includes a body having a foot positioned along a longitudinal axis, and a first arm extending generally perpendicularly from the foot. The assembly may include a second arm also extending generally perpendicular from the foot. Securing elements are provided to secure attachments to the at least one of the first and second arms. These, securing elements may take the forth of adhesive. Although not preferred, the securing elements may also be in the form of a tab, which may be, provided on at least one of the first or second arms, displaced from, or adjacent, the foot, extending generally perpendicularly from the arm.

The outward-facing surface of the assembly may be formed as a single, unitary, monolithic surface that covers both the first and second arms. This outward-facing surface may be treated or untreated, for example, with a laminate or a paper, such as a decor, impregnated with a resin, in order to increase its aesthetic value, or blend, to match or contrast with the panels. Preferably, the outward facing surface has incorporated therein a material to increase its abrasion resistance, such as hard particles of silica, alumina, diamond, silicon nitride, aluminum oxide, silicon carbide and similar hard particles, preferably having a Moh's hardness of at least approximately 6. This outward-facing surface may also be covered with other types of coverings, such as foils (such as paper or thermoplastic foils), paints or a variety of other decorative elements.

The assembly is preferably provided with a securing means to prevent the assembly from moving once assembled. In one embodiment, the securing means is a clamp or track, designed to grab the foot. In a preferred embodiment, the clamp or rail may be joined directly to a subsurface below the floor element, such as a subfloor, by any conventional means, such as a nail, screw or adhesive.

A shim may also be placed between the foot and the subfloor. In one embodiment, the shim may be positioned on the underside of the clamp; however, if a clamp is not used, the shim may be positioned between the foot and the subfloor. The shim may be adhered to either the foot or subfloor using an adhesive or a conventional fastener) e.g., nail or screw.

The assembly may also include a second molding element, for example, in the form of a leveling block or reducer positioned between at least one of the first and second arms and the adjacent floor. The leveling block generally has an upper surface that is adjacent the arm, and a bottom-surface that abuts against the adjacent floor when assembled. In a preferred embodiment, the leveling block has a channel or groove formed in an upper surface, configured to receive the tab on the arm. The particular size of the leveling block is often chosen to conform essentially to the difference in thicknesses between the first and second-panels. The exposed surfaces of the leveling block are typically formed from a variety of materials, such as a carpet, laminate flooring, ceramic or wood tile, vinyl, turf, paper, natural wood or veneer, vinyl, wood, ceramic or composite finish, or any type of covering, while the interior of the leveling block is generally formed from wood, fiberboard, such as high density fiberboard (HDF) or medium density fiberboard (MN), plastics, or other structural material, such as metals or composites, at least over a portion of the surface thereof may be covered with a paint, stain, foil, a plastic, a paper, a décor or a laminate to match or contrast with the first and second amts. The leveling block additionally facilitates the use of floor coverings having varying thicknesses when covering a subfloor. The leveling block helps the molding not only cover the gap, but provide a smoother transition from one surface to another.

Alternatively, the when the tab is used, the tab may be positioned to slidingly engage the edge of a panel when no leveling block is used. A lip may additionally be provided and positioned on the tab in order to slidingly engage a protuberance, adjacent an upper edge of the clamp, in order to retain the assembly in its installed position.

The tab is preferably shaped as to provide forces to maintain the assembly in the installed position. Thus, typically the tab may be frustum-shaped, (e.g., dove-tailed) with its narrow edge proximate the arm and the wider edge furthest from the arm. Additionally, the tab may be lobe shaped, having a bulbous end distal from the arm. In another embodiment, only one side of the tab need be tapered (e.g., half dove-tailed). Of course, any suitable shape is sufficient, as long as the engagement of the tab and groove can provide enough resistive forces to hinder removal of the installed assembly. By forming a suitable groove in the leveling block, the tab can help to secure the assembly in place. Typically, a corresponding groove, having a similar shape as the tab is included in the leveling block or reducer, e.g., having its wider base distal the arm and its narrower opening proximate the arm. It is to be understood by those skilled in the art that although the description throughout this specification is that the position-of the tab is on the at least one of the first and second arms, and the groove is on the attachment, e.g., leveling block, the relative position of the tab and groove can be reversed.

The assembly may additionally be used to cover gaps between tongue-and-groove type panels, such as glue-less laminate floor panels. In addition to the uses mentioned above, the tab may also be designed to mate with a corresponding channel in the panel, the edge of one of the flooring elements, or may actually fit within a grooved edge. In order to better accommodate this type of gap, a second tab may be positioned to depend from the second panel engaging surface.

An adhesive, such as a glue, a microballoon adhesive; contact adhesive, or chemically activated adhesive including a water-activated adhesive, may be also positioned on the abutting surfaces of the first molding element and the second molding element, on the tab, in the groove, on the foot, and on at least one of the arms. Of course, such an adhesive is not necessary, but may enhance or supplement the fit of the assembly over the gap between the floor elements. Additionally, the adhesive may assist in creating a more air-tight or moisture-tight joint.

The assembly may be used in other non-coplanar areas, such as the edge between a wall and a floor, or even on stairs. For example, the assembly may include the first and second arms, and foot as described above, but instead of transitioning between two floor elements placed in the same plane, may form the joint between the horizontal and vertical surfaces of a single stair element, The inventive assembly may be used for positioning between adjacent tongue-and-groove panels; in this regard, the assembly functions as a transition molding, which provides a cover for edges of dissimilar surfaces. For example, when installing floors in a home, the assembly could be used to provide an edge between a hallway and a bedroom, between a kitchen and living or bathroom, or any areas where distinct flooring is desired. Additionally, the assembly may be incorporated into differing types of flooring, such as wood, tile, vinyl, carpet, or turf.

The invention also relates to an inventive method of covering a sub floor adjacent a floor element by use of the inventive joint cover assembly or a kit comprising the joint cover assembly and a corresponding track for affixing the joint cover assembly to a sub floor.

US 2007/024566281 describes a joint cover assembly as well as a method for its installation, wherein the distinct molding elements of the joint cover assembly have a décor on their exposed surfaces and wherein the décor of the distinct exposed surface match. The whole content of US 2007/024566281 is incorporated herein by reference.

Conventionally, such joint cover assemblies and in particular its distinct parts are formed from at least two precursors or blocks which are each, typically, wrapped with a laminate. From the first block, the first molding element, i.e. the T-part, is milled, wherein the second molding element, i.e. the counterpart of the first molding element, is milled from a second block. Although not preferred, the joint between the first and second molding elements is achieved by a tongue-and-groove joint between the first and second molding elements. Subsequently, this joint cover assembly is typically affixed to the subfloor by use of a track in which engages at lest the foot of the first molding element. This, however, requires a complex shape of the distinct molding elements to be joined to each other. Furthermore, the tongue for the tongue-and-groove joint between the first and second molding element is generally manually removed in cases when the first molding element is used for the transition between a floor element and a adjoining carpet.

OBJECT OF THE INVENTION

It was, therefore, an object of the invention to provide a joint cover assembly for covering a gap between two floor elements covering a sub surface having a simple shape and structure, furthermore allowing for an improved and simplified fixation to the sub floor.

This object of the invention is achieved by the joint cover assembly having the features of claim 1 as well as by the kit having the features of claim 17 and the method having the features of claim 19.

Other objects, features and advantages of the present invention will become apparent from the following detailed description. It should be understood, however, that the detailed description and the specific examples, while indicating preferred embodiments of the invention are given by a way of illustration only, since various changes and modifications within the scope of the invention being defined by the claims will become apparent to those skilled in the art from this detailed description.

The joint cover assembly according to the invention provides for an improvement as to the joint of the distinct molding elements to each other by, firstly, providing a gripping groove within the first molding element's foot, and, secondly, by adjusting the dimension of the foot and/or the position and dimension of the gripping groove as to correspond to the distance between a gripping groove's side wall and a proximal side wall of the second molding element's groove.

Due to this shape and the corresponding distances; it is possible to achieve the joint of the joint cover assembly by an engagement of a track only, which in turn is also able to accommodate the foot of the first molding element if the first molding element is used exclusively.

This leads to the advantageous effect that a tongue-and-groove joint between the first and second molding element as known from US 2007/0245662 is not required anymore. Furthermore, the tongue provided at least one of the first molding element's section extending perpendicular to its foot does not have to be removed manually if the first molding element is used on its own, without cooperating with a second molding element. Additionally, because of the invention as described herein, only one single track dimension is sufficient in order to allow for a fixation of the joint cover assembly itself, and for fixing the joint cover assembly or the first molding element only on the sub surface. Finally, due to the less complex shape of the first and second, molding elements in view of the structure known from US 2007/0245662, it is possible, for the first time to provide for a production setup in which one single block is wrapped with the same decorative material, laminate, vinyl, foil, pane, etc., and that all elements of the joint cover assembly according to the invention, i.e. the first molding element as well as at least one further second molding element, can be milled from this one single block. This, of course, provides for the effect that the décor on top of the exposed surfaces of the distinct elements certainly match.

The gripping groove within the foot does not have to be necessarily positioned in the center of the groove. In a preferred embodiment of the invention, however, it is in fact disposed in the center of the foot, thus giving the opportunity that if the external dimension of the foot corresponds to the distance of two adjacent groove side walls of the first and second molding element, the second molding element can be fixed on both sides of the foot by using tracks having the same dimensions. Therefore, as used throughout the specification and claims, "central" means only "disposed somewhere between opposite ends", and is not required to be in the exact middle.

Preferably, the gripping groove within the foot of the first molding element comprises a base portion having an enhanced width or distance between its side walls, wherein this base portion extends along a partial length of the groove. This advantageously provides for a recess of for instance a screw or nail head to be inserted through a track and possibly protruding from a track's base portion into the groove. The foot itself could then be inserted into such track without any clearance or gap due to a protruding fixing element.

Actually, the joint cover assembly according to the invention may preferably have a shape selected from the group consisting of a transition molding, a hard surface reducer, a carpet reducer, and a thus providing for the most common applications of joint cover assemblies in the field of covering a gap between two floor elements covering a sub surface.

In a preferred embodiment of the invention, the second molding element is sized and shaped to form one shape selected from the above-mentioned group, so that the invention advantageously provides for a joint cover assembly having an equally shaped first molding element, and a second molding element being different for the distinct applications, i.e. for a transition molding, a hard surface reducer, a carpet reducer, and a stair nose.

In a particularly preferred embodiment of the invention, the joint cover assembly has a first and second molding element being sized and shaped in the manner explained above, and joined to the first molding element in a first orientation, as well as a second, different, second molding element selected from the group consisting of a transition molding, a hard surface reducer, a carpet reducer, and a stair nose when joined in a second orientation to the first molding element. The joint cover assembly is, thus, able to be used in all usual applications.

As already mentioned above, the joint cover assembly according to the invention comprises a track joining the assembly, and preferably fixing the assembly to the sub surface. In a particularly preferred manner, this track comprises a bottom section to be fixed to the sub surface, and two upstanding sections, for instance two substantially parallel side arms, having a distance corresponding substantially to the width of the foot and also to the distance between a gripping groove's side wall and a proximal side wall of the second molding element's groove. Preferably, the distance between the two upstanding sections of the track corresponds to the external dimension of the first molding element's foot. As used herein, "substantially" means +–up to 5%, as it is often desirable depending upon the material being used, to have the width between the upstanding sections of the track be slightly less than the width of the foot to provide a biasing force to grip the foot. Additionally, the upstanding sections need not be parallel to each other or perpendicular to the base section, as long as such upstanding sections extend away from the base section.

In any case, the track can be used as a recess for the first molding element's foot, or, alternatively, as a recess for the adjacent sidewalls of a joint first and second element of the joint cover assembly according to the invention. Most preferably, the second molding element is then joined to the first molding element via this track only, thus without the need for further adhesive between the two molding elements, or a tongue-and-groove joint between the distinct molding elements, as for instance known from US 2007/0245662.

In a further preferred embodiment of the invention, each of the exposed surfaces of the first and second molding element of the joint cover assembly according to the invention independently comprise a material selected from the group consisting of an abrasion resistant laminate and a foil. More preferably, each of the exposed surfaces of the first and second molding elements comprise an abrasion resistant laminate.

In a further preferred embodiment of the invention, at least one of the first molding element and the second molding element further comprise a core upon which the exposed surface is affixed, the core comprising at least one material selected from the group consisting of plywood, solid wood, particle board, fiber board, strand board, metal, plastic and composite. This is in particular suitable for applications in which, as already discussed above, the distinct molding elements are milled from one block wrapped with a laminate.

The core structure of the distinct components of the joint cover assembly according to the invention may be formed from a core material. Typical core material include wood-based products, such as high density fiber board (HDF), medium density fiber board (MDF), particle board, strand board, plywood and solid wood; polymer-based products, such as polyvinylchloride (PVC), thermoplastics or thermosetting plastics or mixtures of plastic and other products, including the reinforcement; and metals, such as aluminum, stainless steel, brass or copper. The various components of the invention are preferably constructed in accordance with the method disclosed by U.S. application Ser. No. 08/817,391, as well as U.S. application Ser. No. 10/319,820, each of which is herein incorporated by reference in its entirety.

The resulting products typically have a durability rating as defined by European producers of laminate flooring. Such a product can have a durability rating of anywhere from AC 1 to AC 6. Preferably, the product of this invention has a rating of either AC 3 or AC 5.

Preferably, the first molding element comprises a general T-shape, wherein the foot depends generally perpendicularly from a longitudinal axis of the upper section. The first molding element may be provided with a first arm and a second arm extending in a single plain generally perpendicular to the foot. Preferably, the foot, the first arm and the second arm form a general T-shape, with the arms forming the upper structure and the foot forming the lower structure. Although the foot is preferably positioned at a central axis of the first molding element, it may also be preferable to vary the position of the foot "off center" with respect to the first and second arms. For example, the foot may be placed at the midpoint or anywhere in between, thus deviating from a symmetrical shape.

Furthermore, the first molding element need not form a true right angle with its foot. For example, the transition from a respective outstretched arm to a foot may be achieved by one or more rounded sections, or a plurality of straight sections. One or both transitions from the respective arms to the foot may be provided with a mangle.

In a second aspect according to the invention, a kit is provided, comprising the joint cover assembly according to the first aspect discussed in more detail above, and preferably means for affixing the joint cover assembly to a sub surface.

The kit may comprise screws 25, 26 (FIG. 6) and optionally a shim and/or a pad and/or adhesive. The kit, thus, provides for all usually required elements bringing the operator into a position to finally produce the joint cover assembly according to the invention, and to affix the joint cover assembly to the subfloor.

The kit may further include a second molding element in the form of a levelling block otherwise known in the art as reducer. When flooring elements are of different heights, the levelling block is positioned between either the first arm or the second arm of the first molding element as well as the sub floor. Preferably, the size of such levelling block is selected to correspond essentially to the difference in heights of the two flooring elements to be bridged by the joint cover assembly according to the invention.

However, if an adjustable pad is used, the particular height of the reducer is not particularly important. For example, if one flooring element is a ceramic tile, having a thickness of about 2 inches and the second flooring element is vinyl, having a thickness of ¼ inch, the levelling block would typically have a thickness of 1¾ inches to bridge the difference and be placed between a first arm of the first molding element and the other flooring element.

Without the levelling block, a significant space would exist between the second flooring element and the first molding element, allowing for moisture and dirt to accumulate. While the difference in heights of the flooring elements is generally caused by difference and thickness between the two flooring elements, the present invention may also be used to "flatten out" in an even sub floor. In addition, a shim may be placed under the track to adjust for differences in floor thickness.

The track, in general a securing element, such as a metal track or rail, may be coupled to the sub floor by fasteners, such as truss or any conventional coupling method, such as nails or glue. The track and the foot of the first molding element are preferably cooperatively formed so that the foot can be inserted within the track without being removed. For example, the track may be provided with in-turned ends designed to grab the outer surface of the foot to resist separation in a vertical direction. Typically, the foot has a dovetailed shape, having the shorter parallel edge joined to the arms of the first molding element. Furthermore, the track is a channelled element having a corresponding shape as to made with the foot and hold it in place. Finally, each of the T-element, mating section of the food and/or the various grooves may be provided with notched or barbed edges to simultaneously assist in mating a resist disassembly.

The track may additionally be formed of a sturdy, yet pliable material that will outwardly deform as the foot is inserted, but will retain the foot therein. Such materials include, but are not limited to, plastic, wood/polymer composites, wood, and polymers. The track may additionally engage recesses in, for example, sides of the foot.

In a third aspect of the invention, it is provided a method of covering a sub floor adjacent a floor element, the method comprises providing a joint cover assembly according to the first aspect or a kit according to the second aspect, joining the first molding element to the second molding element with the exposed surface of the second molding element facing away from the first molding element, and affixing the joint cover assembly to the sub floor.

Even though the assembly according to the invention may function without any type of glue or adhesive, an alternative embodiment includes the placement of adhesive on the first and/or second molding element. The adhesive may be placed on the molding elements at the factory (for example, pre-glued). Alternatively, the glue may be applied while the floor elements are being assembled. The adhesive may be provided as a strip-type adhesive, but any type of adhesive, such as glue, chemical, or chemically-activated adhesive, water-activated adhesive, contact cements, micro balloon or macro balloon, encapsulated adhesive may be used.

The adhesive may be attached to any location where two pieces of the assembly are joined. Preferably, adhesive is only applied to one of the arms of the first molding element in order to allow or accommodate some slight relative movement that may occur during changes of temperature, for example. This relative movement is known in the flooring art as "float". Allowing float may also eliminate unneeded material stresses as well, thereby reducing warping or deterioration of the material surface.

Typically, the adhesives used in the invention include a fresh adhesive, such as pergoglue (available from Perstorp AB of Perstorp, Sweden), water-activated dry glue, dry glue (needing no activation) or an adhesive strip with a peel-off protector of paper.

BRIEF DESCRIPTION OF THE DRAWINGS

The invention will be explained in more detail with reference to a number of preferred embodiments illustrated in the attached drawings. These figures as well as the preferred embodiments therein are, however, only given for illustrative purposes, thus not being suitable to restrict or delimit the scope provided by the attached claims.

In the figures.

DETAILED DESCRIPTION OF THE PREFERRED EMBODIMENTS

Figure 1:
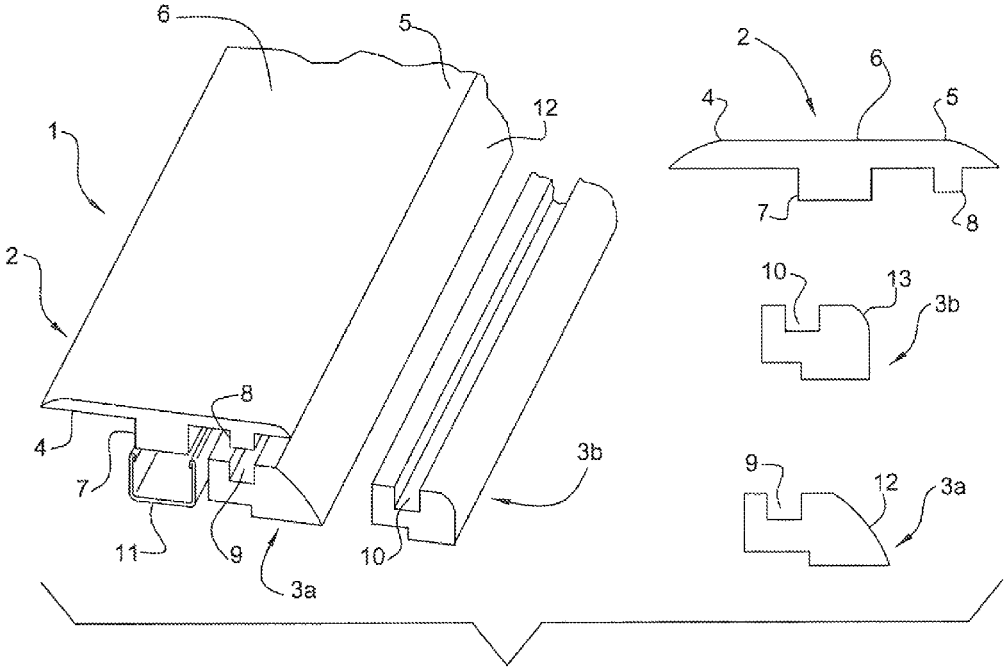
FIG. 1 PRIOR ART
FIG. 1 shows a, joint cover assembly according to the prior art in both a joined state and cross sections of a first and two alternative second molding elements.

In FIG. 1, a joint cover assembly 1 according to U.S. Pat. No. 6,860,047 and comprises a first, T-shaped molding element 2 as well as two different second molding elements 3*a*,3*b*, the first of which 3*a* is illustrated in a near joint position with respect to the first molding element 2. The first molding element 2 has two arms 4,5 being substantially in one plane and supporting the first molding element's exposed surface 6. Perpendicular to the first and second arm 4,5, the first molding element 2 comprises a foot 7 being disposed underneath the exposed surface 6. On the bottom side of the arm 5, a tongue 8 is disposed, which is to cooperate with a corresponding groove 9 disposed within the second molding element 3*a*, or the groove 10 being disposed in the second molding element 3*b*. The foot 7 is to be inserted into a track 11 for fixation of the entire joint cover assembly to a sub surface (not shown). The first molding element 2 is disposed adjacent to a second molding element 3*a* substantially having the form of a quarter round molding. Instead of the molding element 3*a*, the first molding element 2 could also be joined to the second molding element 3*b* being in the form of a wall base molding. As shown in FIG. 1, the exposed surface 12 of the molding element 3*a* follows more or less a quarter circle and provides for a smooth transmission from the exposed surface 6 on top of the first molding element 2 to a sub surface being disposed adjacent to the entire joint cover assembly 1. In the wall base molding 3*b*, the exposed surface 13 comprises a first section being slightly inclined to the vertical direction, and a second section being vertically oriented, thus more or less perpendicular to the exposed surface 6 on top of the first molding element 2.

Figure 2:
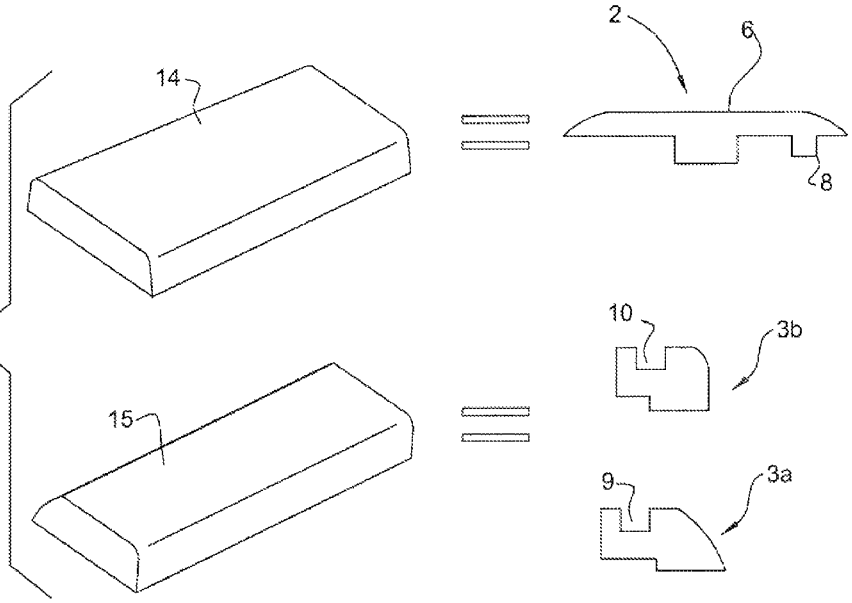
FIG. 2 PRIOR ART
FIG. 2 shows two blocks according to the prior art constituting a precursor material for the distinct molding elements.

FIG. 2 illustrates two blocks 14,15 each being wrapped with a laminate. As shown in FIG. 2, the first block 14 is used as a precursor material for the first molding element 2 to be milled from block 14. The second block 15 is used as a precursor material for the two distinct second molding elements 3*a*,3*b* having the shape and dimension as already discussed in more detail with respect to FIG. 1. This production setup according to the prior art using two distinct blocks each wrapped with the same laminate is necessary due to the complex shape in particular of the arm's underside of the molding element 2 having the tongue 8 being positioned with its lower side facing away from the exposed surface 6. The second molding elements 3*a*,3*b* both provide for respective grooves 9,10 for engagement with the tongue 8 of the first molding element 2.

Figure 3:
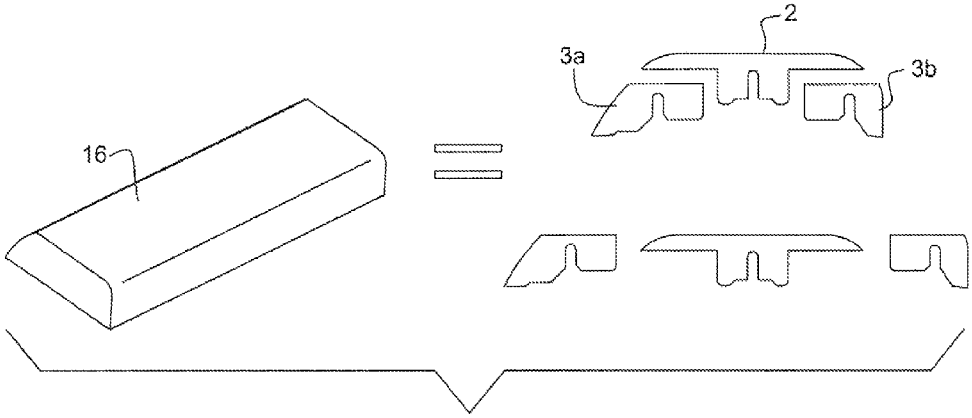
FIG. 3 illustrates a block as a precursor material for a joint cover assembly according to the invention.

FIG. 3 illustrates a production setup according to the present invention in which one single block 16 is wrapped with the same decorative material, laminate, vinyl, foil, paint or the like. All three pieces, i.e., the first molding element 2 and the two distinct second molding elements 3*a*,3*b* are milled from this single block 16 due to the relatively simple structure of the molding elements 2,3*a*,3*b* and in particular due to the flat shape of the surfaces facing the other elements of the joint cover assembly.

Figure 4:
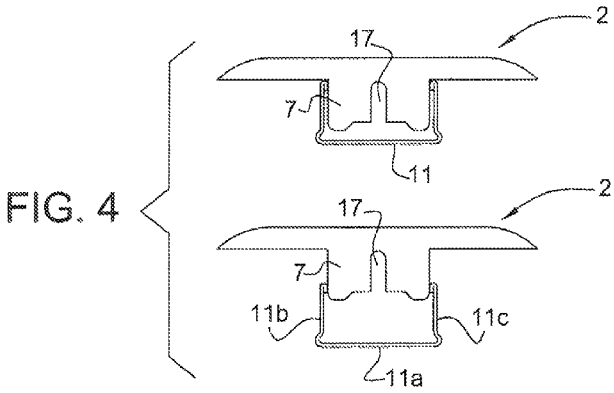
FIG. 4 illustrates a cross-sectional view of a first molding element according to the invention in cooperation with a track.
Figure 6:
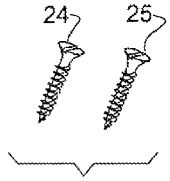
FIG. 6 is a schematic representation of screws that can be included in the kit according to the invention.

FIG. 4 shows a cross section of two first molding elements 2 according to the invention having a gripping groove 17 being disposed in the center of the element's foot 7 and extending towards the exposed surface 6 of the element 2. In the base portion of the foot 7, a recess with a widened distance of the groove's sidewalls and extending along a partial length of the groove 7 is positioned in order to accommodate the head of a screw (not shown) designed to fix the track 11 on a sub surface (not shown). The track 11*a*, 11*b* comprises a base portion 11*a* as well as two upstanding sections in the form of parallel side arms 11*b*,11*c*, wherein the distance between the side arms 11*b*,11*c* substantially corresponds to the external dimension of the foot 7 in order to provide for an engagement of the foot 7 inside the track 11 without a substantial clearance between these two parts 7,11.

Although not shown, the upstanding sections 11*a*, 11*b* of the track can be provided with additional holding means, e.g., flanges or other constructions to assist in mating and being secured with the gripping grove of the foot and second molding element. For example, the distal ends of the upstanding sections may have a "christmas tree" structure comprising one or a plurality of small downwardly angled extensions which pivot during installation and will resist disassembling forces. Similarly, the holding means may consist of a single flange extending inward from the distal end of the upstanding section which can engage the inside of the gripping grove, which groove may be provided with one or more corresponding cut-outs for engagement with the flange.

Figure 5A:
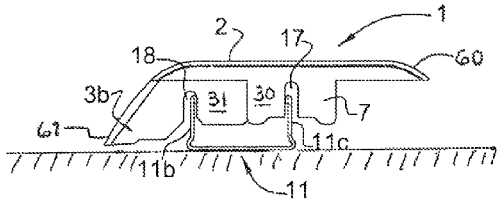
FIG. 5 illustrates three cross-sectional views of a joint cover assembly according to the invention joined via a track only.
Figure 5B:
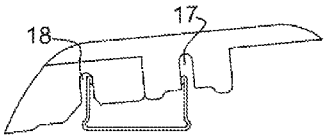
Figure 5C:
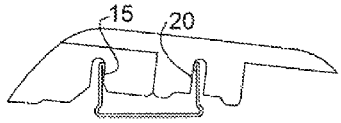

FIG. 5 illustrates a cross sectional view of a joint cover assembly according to the invention, wherein the track 11 engages with its side arms 11*b*, 11*c* into the respective grooves 17,18 provided in each of the first molding element 2 and the second molding element 3*b* shown herein. The width of the track 11, i.e. the distance between the distinct side arms 11*a*,11*b* corresponds to both the external dimension of the foot 7 itself and the distance between the two grooves 7,18 defined by the distance of the two adjacent side walls 19,20 of the first and second molding elements 2,3*b*. The length of the groove 17 and/or the length of the groove 18 may be set in a manner as to compensate for a height difference between a flooring element (not shown) and the height of the second molding element 3*b*, as illustrated in FIGS. 5B and 5C. Alternatively, the side wall 20 of the molding element 2 may also have means for accommodating the tip of the side arm 11*b* of the track 11 at a partial length of the groove 7 in order to compensate for inclinations of the fixed joint cover assembly 1 according to the invention.

FIG. 5*a* illustrates the first and second moldings having a core 30, 31, respectively, upon which exterior surfaces 60, 61, respectively, are affixed.

The invention claimed is:

1. A joint cover assembly for covering a gap between two floor elements covering a subsurface, the assembly comprising:

a first molding element having an exposed surface and having a general T-shape with a lower section having a foot and an upper section consisting substantially of two arms being substantially in one plane and supporting the exposed surface, the exposed surface comprising a décor, wherein the foot has a gripping groove extending towards the exposed surface, said gripping groove being defined by a first inner side wall and a second outer side wall;

a second molding element comprising an upper surface and a lower surface, to be joined to the first molding element, as well as an exposed surface comprising a décor, wherein the lower surface has a second groove extending towards the upper surface, said second groove being defined by a third inner side wall and a fourth outer side wall;

whereby in a joined condition, the upper surface of the second molding element is adjacent to a bottom side of one of the arms of the first molding element; and a track having two upstanding sections, wherein a distance between the upstanding sections corresponds substantially to a distance between the first inner side wall and the third inner side wall;

wherein the joint cover assembly is a hard surface reducer, a carpet reducer, or an end molding.

2. The joint cover assembly according to claim 1, wherein the gripping groove is disposed in the center of the foot.

3. The joint cover assembly according to claim 2, wherein an external dimension of the foot corresponds to a combined length between the first inner side wall and the third inner side wall.

4. The joint cover assembly according to claim 1, wherein the gripping groove comprises a base portion having an enhanced distance between the first inner side wall and the second outer side wall, wherein said base portion extends along a partial length of the groove.

5. The joint cover assembly according to claim 1, wherein the second molding element is sized and shaped such that when joined with the first molding element, the assembly forms one shape selected from the group consisting of a transition molding, a hard surface reducer, a carpet reducer, and an end molding a stair nose.

6. The joint cover assembly according to claim 5, wherein the second molding element is sized and shaped such that when joined with the first molding element, the assembly forms one shape selected from the group consisting of a transition molding, a hard surface reducer, a carpet reducer, a wall base molding, a stair nose, an end molding, and a quarter round molding when joined in a first orientation relative to the first molding element; and a second, different, shape selected from the group consisting of a transition molding, a hard surface reducer, a carpet reducer, a wall base molding, a stair nose, an end molding, and a quarter round molding when joined in a second orientation relative to the first molding element.

7. The joint cover assembly according to claim 1, wherein the track joins the assembly to the subsurface.

8. The joint cover assembly according to claim 7, wherein the track comprises a bottom section to be fixed to the subsurface, said upstanding sections separated by a distance corresponding to an external dimension of the foot.

9. The joint cover assembly according to claim 8, wherein the second molding element is joined to the first molding via the track only.

10. The joint cover assembly according to claim 7, wherein the second molding element is joined to the first molding element via the track only.

11. The joint cover assembly according to claim 10, characterized in that the second molding element is joined to the first molding element via engagement of the upstanding sections with the gripping groove and the second groove.

12. The joint cover assembly according to claim 1, wherein each of the exposed surface of the first molding element and the exposed surface of the second molding element independently comprise a material selected from the group consisting of an abrasion resistant laminate, paint, lacquer, and a foil.

13. The joint cover assembly according to claim 12, wherein each of the exposed surface of the first molding element and the exposed surface of the second molding element comprise an abrasion resistant laminate.

14. The joint cover assembly according to claim 1, wherein at least one of the first molding element and the second molding element further comprise a core upon which the exposed surface is affixed, the core comprising at least one material selected from the group consisting of plywood, solid wood, particle board, fibreboard, strandboard, metal, plastic, and composites.

15. The joint cover assembly according to claim 1, wherein the foot depends generally perpendicularly from a longitudinal axis of the upper section.

16. The joint cover assembly according to claim 1, wherein the décor of the upper section of the first molding element and the décor of the exposed surface of the second molding are substantially identical.

17. A kit comprising:

a first molding element having an exposed surface and a general T-shape with a lower section having a foot, and an upper section consisting substantially of two arms being substantially in one plane and supporting the exposed surface, the exposed surface comprising a décor, wherein the foot has a gripping groove extending towards the exposed surface, said gripping groove being defined by a first inner side wall and a second outer side wall;

a second molding element comprising an upper surface and a lower surface, to be joined to the first molding element, as well as an exposed surface comprising a décor, wherein the lower surface has a second groove extending towards the upper surface, said second groove being defined by a third inner side wall and a fourth outer side wall;

whereby in a joined condition, the upper surface of the second molding element is adjacent to a bottom side of one of the arms of the first molding element; and a track having two upstanding sections, wherein a distance between the upstanding sections corresponds substantially to the distance between the first inner side wall and the third inner side wall.

18. The kit according to claim 17, wherein the kit further comprises screws.

19. The kit according to claim 17, wherein the kit further comprises at least one selected from the group consisting of a shim, a pad and an adhesive.

20. A joint cover assembly for covering a gap between two floor elements covering a subsurface, the assembly comprising:

a first molding element having an exposed surface and a general T-shape with a lower section having a foot, and an upper section consisting substantially of two arms being substantially in one plane and supporting the said exposed surface, the exposed surface comprising a décor, wherein the lower section has at least one gripping groove extending towards the exposed surface, said gripping groove being defined by a first inner side wall and a second outer side wall;

a second molding element comprising an upper surface and a lower surface, to be joined to the first molding element, as well as an exposed surface comprising a décor, wherein the lower surface has a second groove extending towards the upper surface, said second groove being defined by a third inner side wall and a fourth outer side wall;

whereby in a joined condition, the upper surface of the second molding element is adjacent to a bottom side of one of the arms of the first molding element;

the joint cover assembly further comprising a track having two upstanding sections, wherein a distance between the upstanding sections corresponds substantially to the distance between the first inner side wall and the third inner side wall; and wherein the joint cover assembly is a hard surface reducer, a carpet reducer, or an end molding.

* * * * *